US008623108B2

(12) United States Patent
Theisen et al.

(10) Patent No.: US 8,623,108 B2
(45) Date of Patent: Jan. 7, 2014

(54) WEAR-RESISTANT MATERIAL

(75) Inventors: Werner Theisen, Hattingen (DE); Stephan Huth, Bochum (DE); Jochen Perko, Kapellen (AT); Herbert Schweiger, Wartberg (AT)

(73) Assignee: Boehler Edelstahl GmbH & Co KG, Kapfenberg (AT)

( * ) Notice: Subject to any disclaimer, the term of this patent is extended or adjusted under 35 U.S.C. 154(b) by 701 days.

(21) Appl. No.: 12/686,609

(22) Filed: Jan. 13, 2010

(65) Prior Publication Data

US 2010/0192476 A1 Aug. 5, 2010

(30) Foreign Application Priority Data

Jan. 14, 2009 (AT) ..... A 52/2009

(51) Int. Cl.

| | |
|---|---|
| ***B24D 3/02*** | (2006.01) |
| ***C09C 1/68*** | (2006.01) |
| ***C09K 3/14*** | (2006.01) |

(52) U.S. Cl.

USPC ..... 51/309; 420/9; 420/65; 420/69; 420/127; 420/128; 428/323

(58) Field of Classification Search

None

See application file for complete search history.

(56) References Cited

U.S. PATENT DOCUMENTS

| | | | | | |
|---|---|---|---|---|---|
| 3,514,271 | A | * | 5/1970 | Yates | 75/233 |
| 3,515,540 | A | * | 6/1970 | Meadows | 75/252 |
| 3,676,161 | A | * | 7/1972 | Yates | 501/87 |
| 3,890,137 | A | * | 6/1975 | Beyer et al. | 75/252 |
| 4,645,715 | A | * | 2/1987 | Ovshinsky et al. | 428/469 |
| 4,727,740 | A | * | 3/1988 | Yabuki et al. | 72/209 |
| 4,774,052 | A | * | 9/1988 | Nagle et al. | 420/129 |
| 4,800,065 | A | * | 1/1989 | Christodoulou et al. | 420/129 |
| 4,832,912 | A | * | 5/1989 | Yabuki et al. | 420/586 |
| 4,836,982 | A | * | 6/1989 | Brupbacher et al. | 420/129 |
| 4,915,905 | A | * | 4/1990 | Kampe et al. | 420/418 |
| 4,916,029 | A | * | 4/1990 | Nagle et al. | 428/614 |
| 4,921,531 | A | * | 5/1990 | Nagle et al. | 75/351 |
| 4,973,388 | A | * | 11/1990 | Francois et al. | 205/186 |
| 5,015,534 | A | * | 5/1991 | Kampe et al. | 428/570 |

(Continued)

FOREIGN PATENT DOCUMENTS

| | | |
|---|---|---|
| DE | 4202339 | 8/1992 |
| DE | 4231695 | 3/1994 |

(Continued)

OTHER PUBLICATIONS

Ohtsuka, Satoshi et al., "Improvement of Creep Strength of 9CrODS Martensitic Steel by Controlling Excess Oxygen and Titanium Concentrations", Materials Transactions, vol. 46, No. 3 (2005) pp. 487-492.*

(Continued)

*Primary Examiner* — Kaj K Olsen
*Assistant Examiner* — Ross J Christie
(74) *Attorney, Agent, or Firm* — Greenblum & Bernstein, P.L.C.

(57) ABSTRACT

A wear-resistant material which comprises certain concentrations of carbon, nitrogen, oxygen, niobium/tantalum as well as other metallic elements. The material comprises a metal matrix and hard phases embedded therein. The hard phases comprise one or more of carbides, nitrides, carbonitrides, and oxide carbonitrides and have a diameter of from about 0.2 μm to about 50 μm. This abstract is neither intended to define the invention disclosed in this specification nor intended to limit the scope of the invention in any way.

18 Claims, 3 Drawing Sheets

(56) References Cited

U.S. PATENT DOCUMENTS

| | | | | |
|---|---|---|---|---|
| 5,093,148 | A * | 3/1992 | Christodoulou et al. | 427/580 |
| 5,160,553 | A * | 11/1992 | Leban et al. | 148/318 |
| 5,725,687 | A * | 3/1998 | Murakami et al. | 148/312 |
| 5,981,081 | A * | 11/1999 | Sue | 428/564 |
| 6,649,682 | B1 * | 11/2003 | Breton et al. | 524/404 |
| 6,773,662 | B2 * | 8/2004 | Fisher et al. | 420/111 |
| 7,262,240 | B1 * | 8/2007 | Breton et al. | 524/404 |
| 2003/0098097 | A1 * | 5/2003 | Fisher et al. | 148/333 |
| 2006/0048603 | A1 * | 3/2006 | Sundin et al. | 75/238 |
| 2006/0249230 | A1 | 11/2006 | Kajinic et al. | |
| 2008/0253919 | A1 * | 10/2008 | Theisen et al. | 420/12 |
| 2010/0147423 | A1 * | 6/2010 | Siller et al. | 148/579 |
| 2010/0150772 | A1 * | 6/2010 | Siller et al. | 420/84 |

FOREIGN PATENT DOCUMENTS

| | | |
|---|---|---|
| DE | 102005020081 | 9/2006 |
| EP | 0593408 | 4/1994 |
| EP | 172199 | 11/2006 |
| WO | 2007/024192 | 3/2007 |

OTHER PUBLICATIONS

W. Theisen: Verschleissbestaendige Fe-Basislegierungen mit Niobkarbid. Mat-wiss. u. Werkstofftech. 2004, vol. 35, No. 6, pp. 377-384.

European Search report for corresponding application EP 2 253 398, issued Sep. 23, 2010.

Search Report of the Austrian Patent Office, issued Sep. 9, 2009.

* cited by examiner

WEAR-RESISTANT MATERIAL

CROSS-REFERENCE TO RELATED APPLICATIONS

The present application claims priority under 35 U.S.C. §119 of Austrian Patent Application No. A 52/2009, filed on Jan. 14, 2009, the disclosure of which is expressly incorporated by reference herein in its entirety.

BACKGROUND OF THE INVENTION

1. Field of the Invention

The present invention relates to a wear-resistant material comprising carbon (C), nitrogen (N), oxygen (O), one or both of niobium and tantalum (Nb/Ta) as well as metallic elements and impurities as remainder. The material has a microstructure which comprises a metal matrix with hard phases embedded therein.

2. Discussion of Background Information

According to the technical approach, wear-resistant metallic materials comprise a tough or semi-rigid matrix and hard phases distributed therein, which phases are usually shaped as interstitial compounds.

A wear-reducing effect of hard phase inclusions is generally known, wherein a higher hard phase content in the matrix reduces an abrasive removal from the workpiece surface to the greatest extent possible when the support force for the hard material particles and the matrix hardness are high.

According to the prior art, wear-resistant iron-based materials, e.g. cold work steels, comprise a hard, preferably thermally hardened, metal matrix with carbides distributed therein that have been precipitated from the residual melt of the alloy during the hardening.

In a ledeburitic solidification of an alloyed melt in an ingot, a carbide formation may lead to coarse hard phases with inhomogeneous distribution in the material, due to a low rate of solidification in the center thereof and through segregation.

In order to attain a higher concentration of hard phases in the material, in particular with a uniform distribution in the material, it is known to use powder-metallurgical (PM) production methods. In this PM method essentially an alloyed liquid melt, after it has flowed out of a nozzle, is separated into small droplets by means of high-pressure gas jets, which droplets naturally cool at a fast rate and thereby precipitate fine hard phase particles during the hardening. Through a hot isostatic pressing (HIP) or by means of forming the powder in a container, a largely dense material with a high proportion of uniformly distributed hard phases with small grain size is produced.

However, increasing the wear resistance by raising the proportion by volume of hard phases in the matrix of a material and consequently raising the concentration of the elements forming the hard phases has limits in terms of process engineering and reaction-kinetics. During the course of atomization, primary precipitations in the liquid metal can lead to a reduction of their discharge from the nozzle or to a complete closing-off of the passage opening and thus have a disadvantageous effect on the producibility. A major alloy overheating in the supply vat of a metal powder production plant can also have metallurgical and/or reaction-kinetics disadvantages.

Due to the requirement for extremely wear-resistant materials that should optionally have a superior corrosion resistance, alloys have frequently been suggested that have a high content of carbide formers, in particular monocarbide formers, with a corresponding carbon content and a chromium concentration in the matrix of over 12.0% by weight.

For example, DE 42 02 339 B4, the entire disclosure whereof is incorporated by reference herein, proposes a corrosion-resistant, highly wear-resistant, hardenable steel with niobium contents of 5.0 to 8.0% Nb that can be produced without using a powder-metallurgical method.

In order to achieve a wear-resistant matrix with a hard, martensitic structure and a high carbide content even with slow cooling of a component, according to DE 10 2005 020 081 A1, the entire disclosure whereof is incorporated by reference herein, a high content of chromium, molybdenum, vanadium, and above all also nickel is provided, because these elements shift the pearlite nose to the right in the TTT diagram.

DE 42 31 695 A1, the entire disclosure whereof is incorporated by reference herein, discloses alloys in which no expensive chromium is to be lost through carbide formation and proposes to alloy a PM tool steel with 1 to 3.5% by weight of nitrogen.

Nitrogen for hard phase formation is proposed in WO 2007/024 192 A1, the entire disclosure whereof is incorporated by reference herein, as an advantageous measure for the production of wear-resistant materials.

SUMMARY OF THE INVENTION

The present invention provides wear-resistant material. The material comprises, in % by weight:

| | |
|---|---|
| Carbon (C) | from more than 0.3 to about 3.5 |
| Nitrogen (N) | from about 0.05 to about 4.0 |
| Oxygen (O) | from more than 0.002 to about 0.25 |
| Niobium/tantalum (Nb/Ta) | from about 3.0 to about 18.0 |

remainder metallic elements and impurities. Further, the microstructure of the material comprises a metal matrix and hard phases embedded therein. The hard phases comprise carbides and/or nitrides and/or carbonitrides and/or and oxide carbonitrides and have a diameter of from about 0.2 μm to about 50 μm.

In this regard it is noted that "Niobium/tantalum (Nb/Ta)" is intended to mean that either both or one of Nb and Ta is present (preferably at least Nb is present, and Ta may be present or absent). The indicated percentages refer to the total amount of Nb and Ta. Moreover, unless indicated otherwise, all % by weight given herein and in the appended claims are based on the total weight of the material.

In one aspect of the material of the present invention, the matrix may comprise a martensitic microstructure.

In another aspect, the material may comprise not more than about 3.0% by weight of C and/or at least about 0.5% by weight of C and/or the material may comprise at least about 0.15% by weight of N.

In yet another aspect, the material may comprise not more than a total of about 15.0% by weight of Nb and/or Ta.

In a still further aspect, the material may comprise from about 0.2% to about 1.5% by weight of Si and/or from about 0.3% to about 2.0% by weight of Mn and/or from about 10.0% to about 20.0% by weight of Cr and/or from about 0.5% to about 3.0% by weight of Mo and/or from about 0.1% to about 1.0% by weight of V and/or from about 0.001% to about 1.0% by weight of titanium.

In another aspect of the material of the present invention, the material has high corrosion resistance and may comprise, in % by weight:

| | |
|---|---|
| Carbon (C) | from about 0.5 to about 2.5 |
| Nitrogen (N) | from about 0.15 to about 0.6 |
| Silicon (Si) | from about 0.2 to about 1.5 |
| Manganese (Mn) | from about 0.3 to about 2.0 |
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

with the remainder being Iron (Fe) and production-caused impurities.

In this material, preferably the following relationship is satisfied:

$$\%\ C = 0.3 + \frac{\%\ Nb + 2 \times (\%\ V + \%\ Ti)}{U}$$

U having a value of from greater than 6 to lower than 10.

In another aspect of the material of the present invention, the material has high corrosion resistance and may comprise, in % by weight:

| | |
|---|---|
| Carbon (C) | from more than 0.3 to about 1.0 |
| Nitrogen (N) | from about 1.0 to about 4.0 |
| Silicon (Si) | from about 0.2 to about 1.5 |
| Manganese (Mn) | from about 0.3 to about 1.5 |
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

remainder Iron (Fe) and production-caused impurities.

In this material, preferably the following relationship is satisfied:

$$\%\ N = 0.3 + \frac{\%\ Nb + 2 \times (\%\ V + \%\ Ti)}{U1}$$

U1 having a value of from greater than 4 to lower than 8.

In another aspect of the material of the present invention, the material has high corrosion resistance and may comprise, in % by weight:

| | |
|---|---|
| Carbon (C) | from about 0.5 to about 3.0 |
| Nitrogen (N) | from about 0.15 to about 0.6 |
| Silicon (Si) | from about 0.2 to about 1.5 |
| Manganese (Mn) | from about 0.3 to about 2.0 |
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

remainder Iron (Fe) and production-caused impurities.

In this material, preferably the following relationship is satisfied:

$$\%\ C = 0.3 + \frac{\%\ Nb + 2 \times (\%\ V + \%\ Ti)}{U2} + \frac{Cr}{U3}$$

U2 having a value of from greater 6 to lower than 10, and U3 having a value of from greater than 9 to lower than 17.

In another aspect of the material of the present invention, the material has high temperature hardness and ductility and may comprise, in % by weight:

| | |
|---|---|
| Carbon (C) | from about 1.0 to about 3.5 |
| Nitrogen (N) | from about 0.05 to about 0.4 |
| Silicon (Si) | from about 0.2 to about 1.5 |
| Manganese (Mn) | from about 0.3 to about 1.0 |
| Chromium (Cr) | from about 2.5 to about 6.0 |
| Niobium/tantalum (Nb/Ta) | from about 3.0 to about 18.0 |
| Molybdenum (Mo) | from about 2.0 to about 10.0 |
| Tungsten (W) | from about 0.1 to about 12.0 |
| Vanadium (V) | from about 0.1 to about 3.0 |
| Cobalt (Co) | from about 0.1 to about 12.0 |

remainder Iron (Fe) and production-caused impurities.

In this material, preferably the following relationship is satisfied:

$$\%\ C = 0.6 + \frac{\%\ Nb + 2 \times (\%\ V + \%\ Ti)}{U4} + \frac{2 \times \%\ Mo + \%\ W}{U5}$$

U4 having a value of from about 6 to about 10, and U5 having a value of from about 80 to about 100.

The present invention also provides a metal cutting tool which comprises the material of the present invention as set forth above.

The present invention also provides a method of producing a wear-resistant material (e.g., a material according to the present invention as set forth above, including the various aspects thereof.) The method comprises (a) atomizing a metallic, liquid alloy which comprises a total of from about 3.0% to about 18.0% by weight of niobium and/or tantalum as well as carbon and/or nitrogen, in which alloy no primary precipitations of carbides and/or nitrides are formed above the atomization temperature or liquidus temperature, to produce a powder material, (b) subjecting the powder material to a process of increasing its content of one or more of carbon, nitrogen, and oxygen, and (c) subsequently subjecting the powder material to a hot compacting, for example, a hot isostatic pressing, wherein the pressing or HIP body is subjected to a hot-forming and/or a heat treatment.

In one aspect of the method, the powder material is mixed with elementary carbon and/or subjected to an atmosphere which comprises at least one of carbon and nitrogen, optionally at elevated temperature.

BRIEF DESCRIPTION OF THE DRAWINGS

The present invention is further described in the detailed description which follows, in reference to the drawings by way of non-limiting examples of exemplary embodiments of the present invention, and wherein.

DETAILED DESCRIPTION OF THE PRESENT INVENTION

Figure 1:
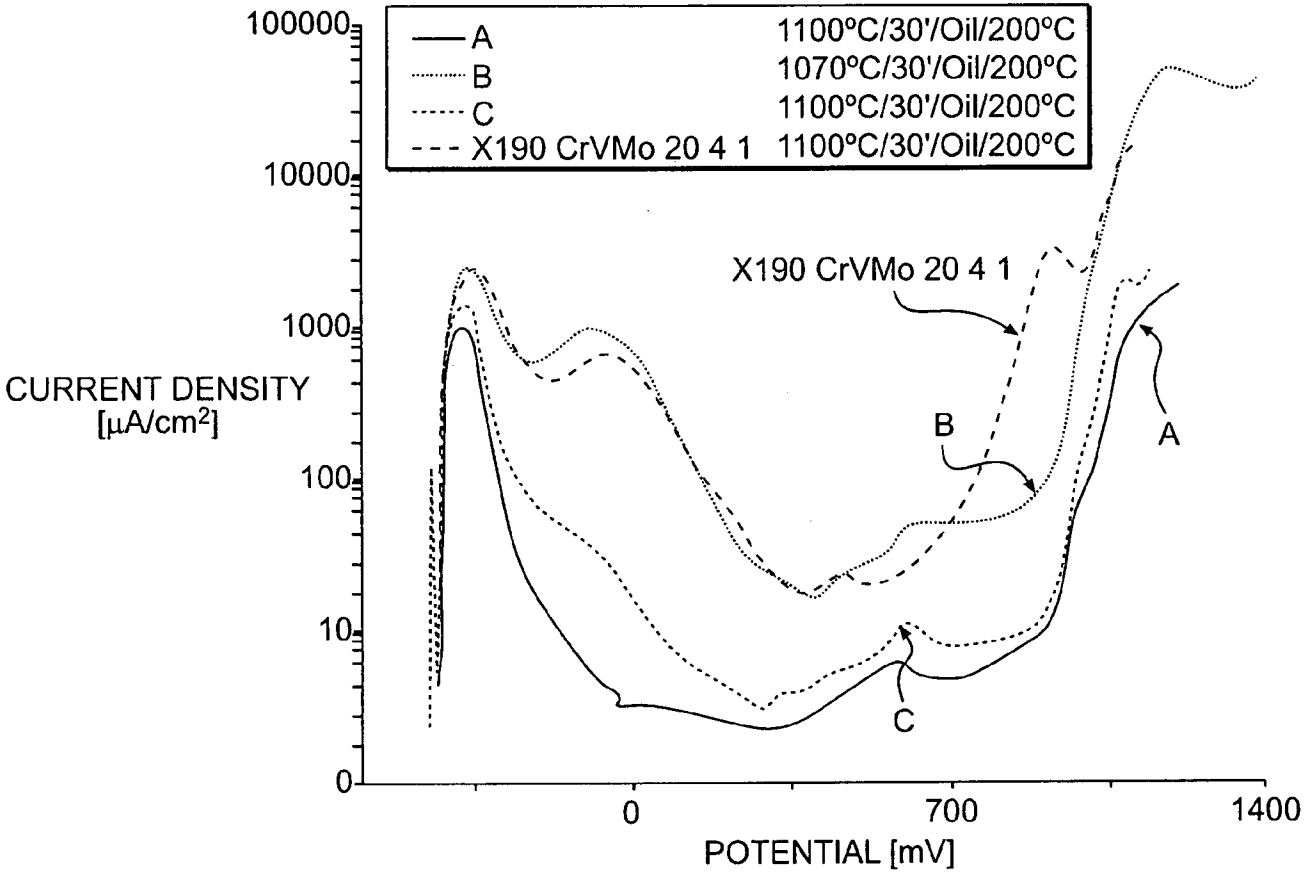
FIG. 1 is a graph showing the potential as a function of the current density, obtained by subjecting materials according to the present invention and a comparative material to a corrosion test.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Advantages of the wear-resistant material according to the present invention may include that due to the niobium/tantalum concentration of from about 3.0% to about 18.0% by weight and the carbon content of from about 0.3% to about 3.5% (and preferably about 3.0%) by weight as well as the nitrogen content of from about 0.05% to about 4.0% by weight, high-hardness niobium and/or tantalum monocarbides, mononitrides, or monocarbonitrides are present with a homogeneous distribution and with small diameter and thus a high abrasion resistance is achieved.

With lower contents of carbon than about 0.3% by weight and of nitrogen than about 0.05% by weight the formation potential of compounds with contents of from about 3.0% to about 18.0% by weight of Nb/Ta cannot be utilized to the fullest extent; on the other hand higher contents than about 3.5%/4.0% by weight of carbon/nitrogen may be detrimental to the microstructure.

The oxygen content of from about 0.0020% to about 0.25% by weight in the material acts on the one hand as a nucleus for the formation of the hard phase as far as hard material particles with a defined small size in homogeneous distribution in the matrix are concerned, and on the other hand acts as its own hard material former.

Higher oxygen contents than about 0.25% by weight tend to embrittle the hard phases, whereas contents lower than about 0.0020% by weight have no pronounced nucleating effect.

According to the invention the hard material particles have a diameter of not more than about 50 μm, because with larger phases the danger is increased that they will suddenly break out of the matrix. Smaller diameters than about 0.2 μM of the hard phases result in only a low abrasion-reducing effect.

If, as in a preferred aspect of the present invention, the matrix of the wear-resistant alloy has a martensitic microstructure, the material itself has an increased abrasion-reducing hardness, wherein it is extremely probable that the danger of hard phases breaking out from the structure under wear stress is minimized.

In a preferred aspect of the material of the present invention, wherein a high resistance to removal under abrasion stress and high corrosion resistance is desired, the material comprises, in % by weight:

| | |
|---|---|
| Carbon (C) | from about 0.5 to about 2.5 |
| Nitrogen (N) | from about 0.15 to about 0.6 |
| Silicon (Si) | from about 0.2 to about 1.5 |
| Manganese (Mn) | from about 0.3 to about 2.0 |
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

with the remainder being Iron (Fe) and production-caused impurities.

In this material, the following relationship is preferably satisfied:

$$\% \text{ C} = 0.3 + \frac{\% \text{ Nb} + 2 \times (\% \text{ V} + \% \text{ Ti})}{U}$$

U having a value of from greater than 6 to lower than 10.

The concentrations of the alloy metals in this material are harmonized with one another as far as the carbon activity and the carbide formation kinetics of the respective elements are concerned, wherein the contents of the monocarbide formers are decisive for the intended carbon concentration. The concentration of nitrogen has an upper value of about 0.6% by weight because in the given case the hard phases are to be embodied predominantly as carbides. Below about 0.15% by weight of nitrogen the hardening effect of the matrix is usually too low.

Silicon acts as a deoxidation metal and influences the structural transition of the alloy during the heat treatment. A lower concentration of about 0.2% by weight of Si is desirable with respect to an effective oxide formation, whereas higher concentrations than about 1.5% by weight usually have a disadvantageous effect on the ductility.

A manganese concentration of about 0.3% by weight and above is provided for a binding of sulfur in the material, wherein more than about 2.0% by weight of Mn promote an austenitic stability that has a disadvantageous effect.

Chromium and molybdenum cause a corrosion resistance of the alloy at concentrations of as low as 10.0% and 0.5% by weight, respectively, but can also be effective as carbide formers. Higher concentrations than about 20% by weight of Cr and about 3.0% by weight of Mo usually lead in a disadvantageous manner to a stabilization of ferrite during a heat treatment.

Vanadium and titanium should preferably not exceed concentrations of respectively about 1.0% by weight because carbides of these elements dissolve Cr to a great extent or incorporate it into the crystal lattice, so that a depletion of Cr can arise in the edge areas of the matrix. Through this local chromium depletion, a disturbance of the formation of a stable passive layer at the surface takes place, as a result of which the corrosion resistance of the alloy is impaired. In % by weight, as little as about 0.1 of vanadium and/or about 0.001 of titanium have a favorable effect for a formation of monocarbide nuclei.

Niobium and tantalum are elements which at a concentration above about 3.0% by weight form hard monocarbides that promote the wear-resistance of the material in the alloy. It is important thereby that these in particular Nb/Ta elements show only a low tendency to incorporate further elements, in particular chromium, into the crystal lattice during the carbide- or carbonitride formation, so that in the neighborhood of the corresponding hard phases no depletion of alloy components in the matrix arises, in particular depletion of chromium and molybdenum, and thus no disadvantageous effect occurs on the corrosion resistance of the material.

According to a further preferred aspect of the material of the present invention, a low wear and a high corrosion resistance of the material may be achieved if the material comprises, in % by weight:

| | |
|---|---|
| Carbon (C) | from more than 0.3 to about 1.0 |
| Nitrogen (N) | from about 1.0 to about 4.0 |
| Silicon (Si) | from about 0.2 to about 1.5 |
| Manganese (Mn) | from about 0.3 to about 1.5 |
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

remainder Iron (Fe) and production-caused impurities.

In this material, the following relationship is preferably satisfied:

$$\%\ N = 0.3 + \frac{\%\ Nb + 2 \times (\%\ V + \%\ Ti)}{U1}$$

U1 having a value of from greater than 4 to lower than 8.

The high nitrogen content of from about 1.0% to about 4.0% by weight with carbon concentrations of from about 0.3% to about 1.0% by weight leads to hard phases formed essentially of nitrides, while the passive layer formation effected through chromium and molybdenum as well as the corrosion resistance is promoted.

Taking into consideration the chromium content as far as corrosion resistance is concerned and in orienting the wear resistance essentially to carbides, according to a further aspect of the material of the present invention, a material can be prepared in a favorable and cost-effective manner that comprises in % by weight:

| | |
|---|---|
| Carbon (C) | from about 0.5 to about 3.0 |
| Nitrogen (N) | from about 0.15 to about 0.6 |
| Silicon (Si) | from about 0.2 to about 1.5 |
| Manganese (Mn) | from about 0.3 to about 2.0 |

-continued

| | |
|---|---|
| Chromium (Cr) | from about 10.0 to about 20.0 |
| Niobium/tantalum (Nb/Ta) | from about 3.0 to about 15.0 |
| Molybdenum (Mo) | from about 0.5 to about 3.0 |
| Vanadium (V) | from about 0.1 to about 1.0 |
| Titanium (Ti) | from about 0.001 to about 1.0 |

remainder Iron (Fe) and production-caused impurities.

In this material, the following relationship is preferably satisfied:

$$\%\ C = 0.3 + \frac{\%\ Nb + 2 \times (\%\ V + \%\ Ti)}{U2} + \frac{Cr}{U3}$$

U2 having a value of from greater 6 to lower than 10, and U3 having a value of from greater than 9 to lower than 17.

If in addition to high wear-resistance, high temperature hardness and the like ductility is also required of a material according to the invention, as is of particular great importance for metal-cutting tools, the alloy with lowered contents of chromium can have the following composition and relations of the elements in % by weight:

| | |
|---|---|
| Carbon (C) | from about 1.0 to about 3.5 |
| Nitrogen (N) | from about 0.05 to about 0.4 |
| Silicon (Si) | from about 0.2 to about 1.5 |
| Manganese (Mn) | from about 0.3 to about 1.0 |
| Chromium (Cr) | from about 2.5 to about 6.0 |
| Niobium/tantalum (Nb/Ta) | from about 3.0 to about 18.0 |
| Molybdenum (Mo) | from about 2.0 to about 10.0 |
| Tungsten (W) | from about 0.1 to about 12.0 |
| Vanadium (V) | from about 0.1 to about 3.0 |
| Cobalt (Co) | from about 0.1 to about 12.0 |

remainder Iron (Fe) and production-caused impurities.

In this material, the following relationship is preferably satisfied:

$$\%\ C = 0.6 + \frac{\%\ Nb + 2 \times (\%\ V + \%\ Ti)}{U4} + \frac{2 \times \%\ Mo + \%\ W}{U5}$$

U4 having a value of from about 6 to about 10, and U5 having a value of from about 80 to about 100.

The highly wear-resistant tool material based on a type of high-speed steel alloy can be hardened to high hardness values in a simple manner, and in spite of high hardness has outstanding ductility. The wear-resistance of cutting tools formed from this alloy is particularly pronounced, which tools as a result have a particularly high service life in coarse and interrupted cutting.

In the method according to the invention of the type mentioned at the outset in a first step a metallic, liquid alloy comprising niobium/tantalum (Nb/Ta) at a concentration of from about 3.0% to about 18.0% by weight as well as a content of carbon and/or nitrogen, in which alloy no primary precipitations of carbides and/or nitrides are formed above the atomization temperature or liquidus temperature, is atomized to form a powder material. The powder is subjected to a method of increasing the carbon content and/or the nitrogen content and/or the oxygen content thereof and subsequently is subjected to a hot compacting, in particular a hot isostatic pressing, wherein the pressing or HIP body is subjected to a hot-forming and/or a heat treatment.

Because primary carbide- and nitride precipitations can be formed at high Nb/Ta contents, it is provided according to the present invention to hold the contents of carbon and nitrogen below the limit for a precipitation formation in an otherwise completely combined, liquid pre-alloy, and to atomize this liquid metal, preferably by means of nitrogen, to form powder material. A solid metal powder obtained in this manner is subsequently carburized in a targeted manner through suitable means at elevated temperature and/or its nitrogen content and/or oxygen content is raised to intended levels. A powder whose composition has been adjusted in this way according to the invention may be placed in containers according to the prior art and can be compacted and brought to desired dimensions through hot isostatic pressing (HIP) or forming at high temperature.

The method according to the invention has the advantage that materials with a high carbide-nitride or carbonitride hard material content can be produced, wherein the hard substance particles have a small diameter and a homogeneous distribution in the matrix. The matrix elements can endow the material with a high strength through a thermal hardening or through a hardening and tempering of the material and to a great extent can prevent a stripping or breaking-out of the larger optimized hard material particles. A particularly pronounced wear resistance of the material is achieved thereby.

According to the invention a carburization and/or an increase in the nitrogen content with adjustment of the oxygen content of the pre-alloyed metal powder can be brought about through admixed elementary carbon and/or through an atmosphere which comprises/releases carbon and/or nitrogen and/or oxygen, in particular at elevated temperature before or during a hot compacting.

In one embodiment of the invention further hard material particles with a size of form about 2 to about 50 μm can be admixed with the powder material, preferably in an amount of up to about 25% by volume, which particles are subsequently effective in reducing wear for the given material.

Based on examples representing only implementation methods, in comparison to known materials the properties of the alloy according to the present invention are illustrated in more detail.

Table 1 below sets forth the compositions of two commercially available wear-resistant alloys with the designations X190 CrVMo 20 4 1, X90 CrVMo 18 1 1, of corrosion-resistant alloys according to the invention with the designations A, B, C, and of cutting materials according to the invention with the designations D, E, F.

The commercially available alloys had been produced by the PM method with a forming of the HIP block (Hot Isostatic Pressed) of larger than 6-fold. Powders for the samples designated A, B, C were produced, through atomization by means of nitrogen gas, from alloys with the following main constituents in % by weight:

| Designation | Si | Mn | Cr | Mo | V | W | Nb | Co | Fe |
|---|---|---|---|---|---|---|---|---|---|
| A | 0.43 | 0.42 | 11.92 | 2.21 | 0.08 | 0.07 | 9.02 | 0.08 | Remainder |
| B | 0.51 | 0.44 | 16.41 | 2.19 | 0.09 | 0.07 | 9.56 | 0.05 | Remainder |
| C | 0.43 | 0.42 | 11.92 | 2.21 | 0.05 | 0.06 | 9.02 | 0.08 | Remainder |

An atomization with nitrogen gas further was carried out using melts with the designation D, E, F with the main constituents in % by weight:

| Designation | Si | Mn | Cr | Mo | V | W | Nb | Co | Fe |
|---|---|---|---|---|---|---|---|---|---|
| D | 0.30 | 0.40 | 4.15 | 2.94 | 1.52 | 2.13 | 3.34 | 0.12 | Remainder |
| E | 0.28 | 0.35 | 3.95 | 2.84 | 1.47 | 2.23 | 3.45 | 8.21 | Remainder |
| F | 0.37 | 0.33 | 3.58 | 4.10 | 1.84 | 5.07 | 10.73 | 7.07 | Remainder |

The following were used as carburization agents by way of experiment for the materials with the designations A to C:

$CH_4$+O

Graphite (admixed) and nitrogen+O $CH_4$+nitrogen+O, wherein about 10% NbC with a grain size of 28 μm was admixed with the metal powders.

The metal powders of the further alloys D to F were treated in the tests with the following carburization- and nitridation means:

CO+$CH_4$+O

CO+N+O

Graphite+CO+N+O.

The further alloying of the alloy powders with carbon, nitrogen, and oxygen took place at elevated temperature.

The further alloyed metal powder was subsequently introduced into steel containers under a nitrogen atmosphere and compacted by beating, after which a welding of the containers and a hot isostatic pressing was carried out at a temperature of 1165° C.

Figure 2:
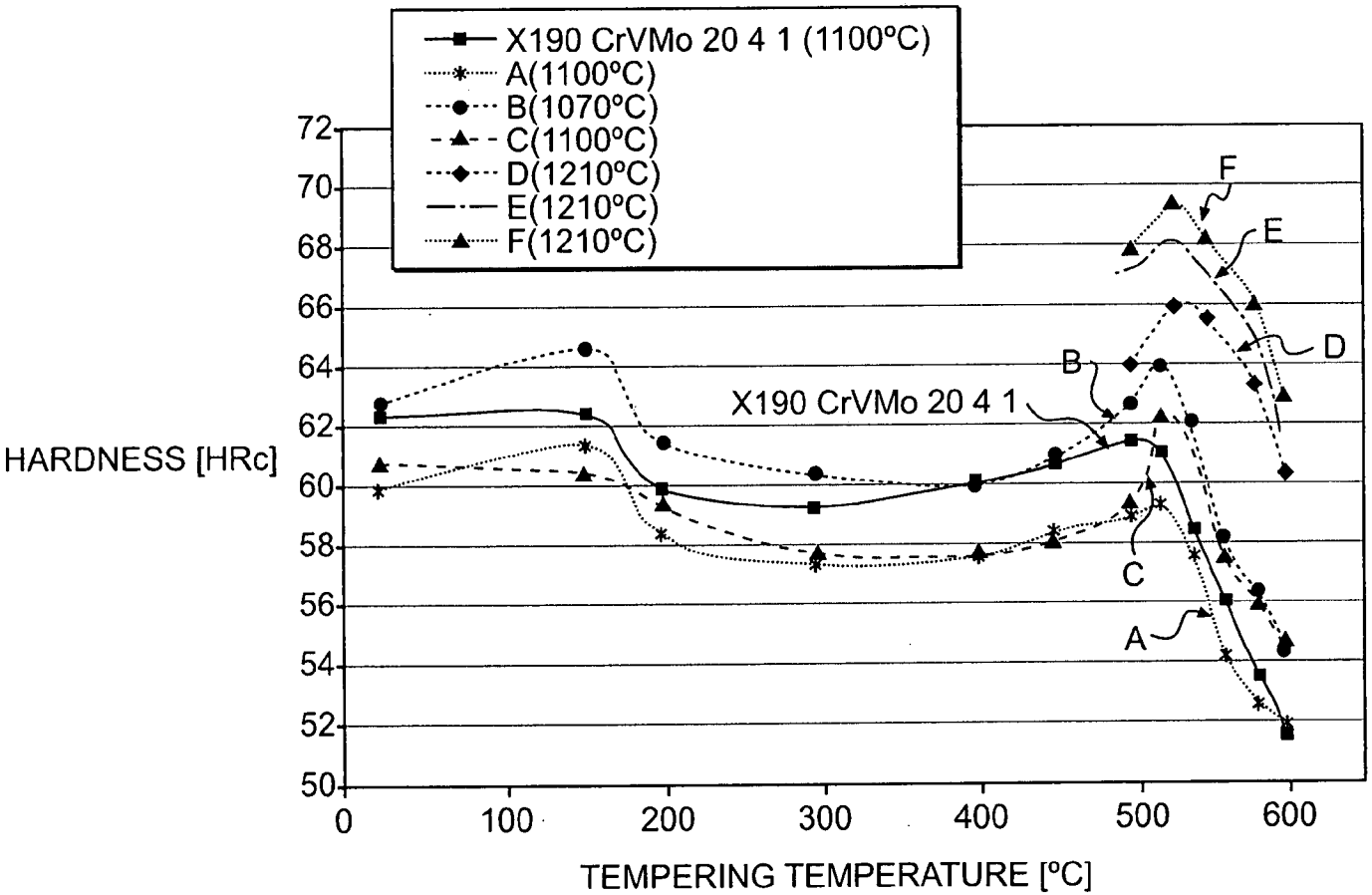
FIG. 2 is a graph which shows the hardness of materials of the present invention and a comparative material after a hardening with two temperings as a function of the tempering temperature.
Figure 3:
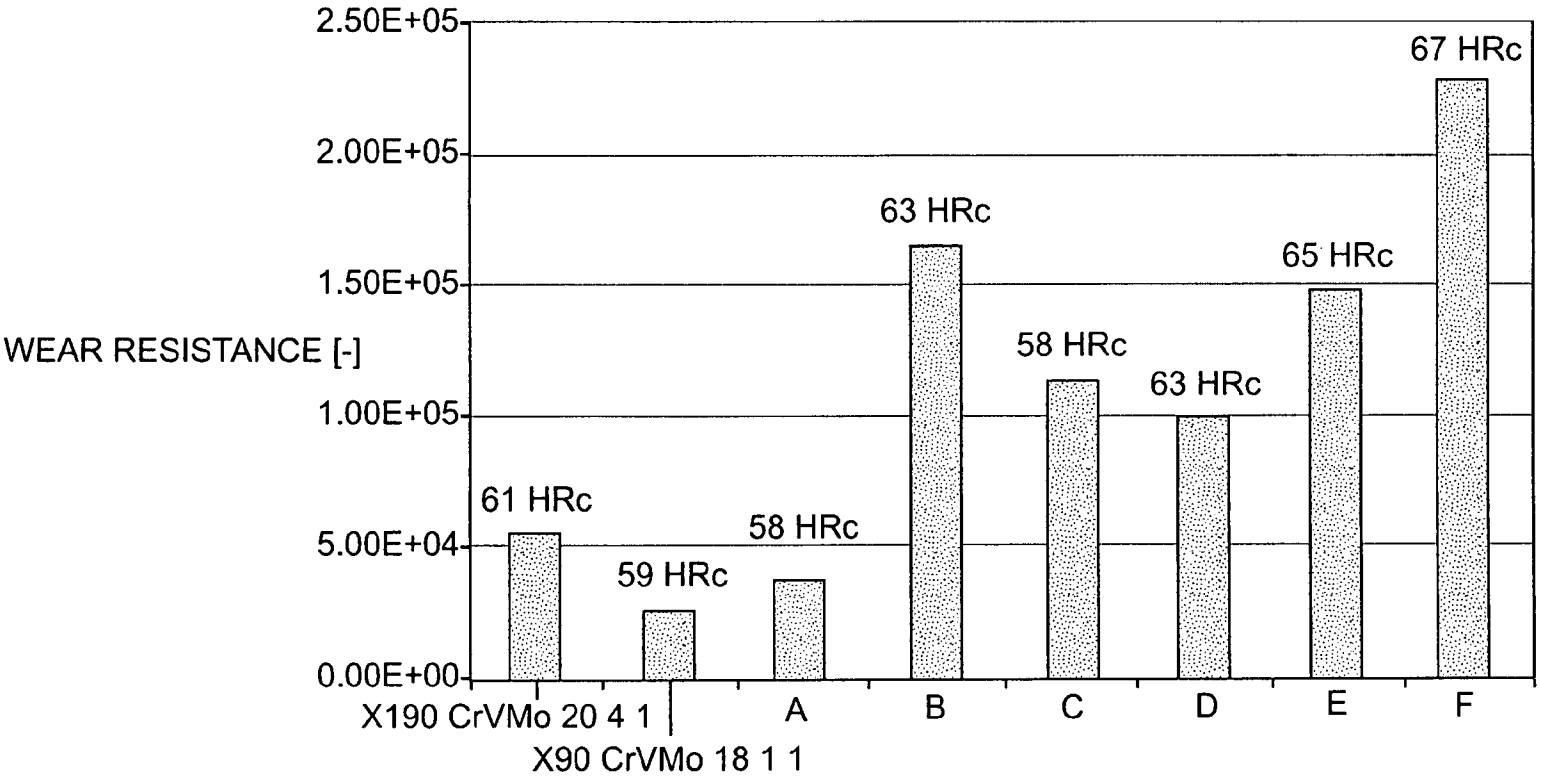
FIG. 3 is a graph which shows the wear resistance of samples prepared from materials of the present invention and from comparative materials, determined according to the pin-on-disk test.

After a hot-forming of the HIP block, samples were taken from the product, analyzed (Table 1) and tested, wherein significant results are shown in FIG. 1 to FIG. 3.

TABLE 1

| Designation | C | N | Si | Mn | Cr | Mo | V | W | Nb | Co |
|---|---|---|---|---|---|---|---|---|---|---|
| X190 CrVMo 20 4 1 | 1.90 | 0.20 | 0.70 | 0.30 | 20.00 | 1.00 | 4.00 | 0.60 | — | — |
| X90 CrVMo 18 1 1 | 0.90 | 0.01 | 0.40 | 0.40 | 18.00 | 1.10 | 1.00 | 0.06 | — | — |
| A | 1.45 | 0.18 | 0.42 | 0.41 | 11.76 | 2.18 | 0.08 | 0.07 | 8.90 | 0.08 |
| B | 2.30 | 0.19 | 0.50 | 0.43 | 16.05 | 2.14 | 0.09 | 0.07 | 9.35 | 0.05 |
| C | 1.45 | 0.18 | 0.42 | 0.41 | 11.76 | 2.18 | 0.05 | 0.06 | 8.90 | 0.08 |
| D | 1.30 | 0.08 | 0.30 | 0.40 | 4.10 | 2.90 | 1.50 | 2.10 | 3.30 | 0.12 |
| E | 1.40 | 0.07 | 0.28 | 0.35 | 3.90 | 2.80 | 1.45 | 2.20 | 3.40 | 8.10 |
| F | 2.45 | 0.08 | 0.36 | 0.32 | 3.50 | 4.00 | 1.80 | 4.95 | 10.48 | 6.90 |

Table 1 shows the chemical composition of known materials (X190 CrVMo 4 1 as well as X90 CrMoV 18 1 1) and that of steel samples according to the invention Corrosion Behavior:

The corrosion behavior of the alloys was determined for the samples according to ASTM G65 in 1 n $H_2SO_4$, 20° C., based on current density potential curves, wherein a quenching of the samples of 1100° C. or 1070° C. and a tempering at 200° C. took place.

As can be taken from FIG. 1, in the relevant potential range of approx. −300 mV to +300 mV the comparative alloy X190 CrVMo 20 4 1 essentially has the highest passive current density when compared to the samples A, B, C according to the present invention, which illustrates their improved corrosion behavior.

FIG. 2 shows the hardness of the tested alloys after a hardening as a function of the tempering temperature after two temperings.

The respective hardening temperature can be gathered from the designation field for the alloys.

Compared to X190 CrVMo 20 4 1, materials A and C of the alloy according to the invention have a comparably low tempering hardness, because their respective carbon content was selected to be low for the sake of an improved corrosion resistance (see FIG. 1).

The material hardnesses of the alloys D, E, and F are decisively higher in the range of tempering temperatures between 500° C. and 600° C., which discloses a clear superiority of the same for a use of for example cutting- and forming elements.

FIG. 3 shows the wear behavior of the samples prepared from the alloys, ascertained according to the pin-on-disk test with 80 mesh flint described in VDI Progress Reports "Sickstofflegierte Werkzeugstähle ("Nitrogen-alloyed tool steels"), Series 5, No. 188 (1990), p. 129. The hardnesses of the samples are given over the respective bar in FIG. 3. Both the corrosion-resistant alloy B and the alloys E and F according to the invention exhibit outstanding resistance to wear, which points to a correspondingly favorable selection of carbon- and niobium contents.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A wear-resistant material, wherein the material comprises, in % by weight:

Carbon (C) from more than 0.3 to about 3.5

Nitrogen (N) from about 0.05 to about 4.0

Oxygen (O) from more than 0.002 to about 0.25

Niobium or tantalum or both niobium and tantalum (Nb/Ta) from about 3.0 to about 18.0 remainder metallic elements and impurities, and wherein a microstructure of the material comprises a metal matrix and hard phases embedded therein, the hard phases comprising one or more of carbides, nitrides, and carbonitrides of at least Nb/Ta and having a diameter of from about 0.2 μm to about 50 μm.

2. The material of claim 1, wherein the matrix comprises a martensitic microstructure.

3. The material of claim 1, wherein the material comprises from more than 0.3 to not more than about 3.0% by weight of C.

4. The material of claim 1, wherein the material comprises at least about 0.5% to about 3.5% by weight of C.

5. The material of claim 1, wherein the material comprises at least about 0.15% to about 4.0% by weight of N.

6. The material of claim 1, wherein the material comprises at least niobium.

7. The material of claim 6, wherein the material comprises from about 3.0 to not more than a total of about 15.0% by weight of Nb/Ta.

8. The material of claim 1, wherein the material comprises from about 0.2% to about 1.5% by weight of Si.

9. The material of claim 1, wherein the material comprises from about 0.3% to about 2.0% by weight of Mn.

10. The material of claim 1, wherein the material comprises from about 10.0% to about 20.0% by weight of Cr.

11. The material of claim 1, wherein the material comprises from about 0.5% to about 3.0% by weight of Mo.

12. The material of claim 1, wherein the material comprises from about 0.1% to about 1.0% by weight of V.

13. The material of claim 1, wherein the material comprises from about 0.001% to about 1.0% by weight of titanium.

14. The material of claim 1 wherein the material comprises, in % by weight:

Carbon (C) from about 0.5 to about 2.5

Nitrogen (N) from about 0.15 to about 0.6

Silicon (Si) from about 0.2 to about 1.5

Manganese (Mn) from about 0.3 to about 2.0

Chromium (Cr) from about 10.0 to about 20.0

Nb/Ta from about 3.0 to about 15.0

Molybdenum (Mo) from about 0.5 to about 3.0

Vanadium (V) from about 0.1 to about 1.0

Titanium (Ti) from about 0.001 to about 1.0 remainder Iron (Fe) and production-caused impurities, and wherein:

$$\%C=0.3+\%Nb+2\times(\%V+\%Ti)/U$$

U having a value of from greater than 6 to lower than 10, and wherein the material has a high corrosion resistance.

15. The material of claim 1 wherein the material comprises, in % by weight:

Carbon (C) from more than 0.3 to about 1.0
Nitrogen (N) from about 1.0 to about 4.0
Silicon (Si) from about 0.2 to about 1.5
Manganese (Mn) from about 0.3 to about 1.5
Chromium (Cr) from about 10.0 to about 20.0
Nb/Ta from about 3.0 to about 15.0
Molybdenum (Mo) from about 0.5 to about 3.0
Vanadium (V) from about 0.1 to about 1.0
Titanium (Ti) from about 0.001 to about 1.0
remainder Iron (Fe) and production-caused impurities, and wherein:

$$\%N=0.3+\%Nb+2\times(\%V+\%Ti)/U1$$

U1 having a value of from greater than 4 to lower than 8, and wherein the material has a high corrosion resistance.

16. The material of claim 1 wherein the material comprises, in % by weight:

Carbon (C) from about 0.5 to about 3.0
Nitrogen (N) from about 0.15 to about 0.6
Silicon (Si) from about 0.2 to about 1.5
Manganese (Mn) from about 0.3 to about 2.0
Chromium (Cr) from about 10.0 to about 20.0
Nb/Ta from about 3.0 to about 15.0
Molybdenum (Mo) from about 0.5 to about 3.0
Vanadium (V) from about 0.1 to about 1.0
Titanium (Ti) from about 0.001 to about 1.0
remainder Iron (Fe) and production-caused impurities, and wherein:

$$\%C=0.3+\%Nb+2\times(\%V+\%Ti)/U2+Cr/U3$$

U2 having a value of from greater 6 to lower than 10, and
U3 having a value of from greater than 9 to lower than 17, and wherein the material has a high corrosion resistance.

17. The material of claim 1 with high temperature hardness and ductility, wherein the material comprises, in % by weight:

Carbon (C) from about 1.0 to about 3.5
Nitrogen (N) from about 0.05 to about 0.4
Silicon (Si) from about 0.2 to about 1.5
Manganese (Mn) from about 0.3 to about 1.0
Chromium (Cr) from about 2.5 to about 6.0
Nb/Ta from about 3.0 to about 18.0
Molybdenum (Mo) from about 2.0 to about 10.0
Tungsten (W) from about 0.1 to about 12.0
Vanadium (V) from about 0.1 to about 3.0
Cobalt (Co) from about 0.1 to about 12.0
Titanium (Ti) from about 0.001 to about 1.0
remainder Iron (Fe) and production-caused impurities, and wherein:

$$\%C=0.6+\%Nb+2\times(\%V+\%Ti)/U4+2\times\%Mo+\%W/U5$$

U4 having a value of from about 6 to about 10, and
U5 having a value of from about 80 to about 100, and wherein the material has high temperature hardness and ductility.

18. A metal cutting tool which comprises the material of claim 17.

* * * * *